United States Patent [19]

Larsson

[11] 4,132,442

[45] Jan. 2, 1979

[54] APPARATUS FOR PICKING-UP AND REMOVING OBJECTS

[76] Inventor: Karl O. A. H. Larsson, Industriestrasse 40, Zug, Switzerland

[21] Appl. No.: 782,261

[22] Filed: Mar. 25, 1977

[30] Foreign Application Priority Data

Mar. 31, 1976 [CH] Switzerland ..... 4017/76
Nov. 30, 1976 [CH] Switzerland ..... 15093/76

[51] Int. Cl.[2] ..... A47I 13/52
[52] U.S. Cl. ..... 294/25; 294/1 R
[58] Field of Search ..... 294/1 R, 19 R, 25, 16, 294/55, 118; 15/104.8, 257.1; 119/1 R; 299/62, 66

[56] References Cited

U.S. PATENT DOCUMENTS

| | | | |
|---|---|---|---|
| 3,813,121 | 5/1974 | Marvin | 294/1 R |
| 3,830,423 | 8/1974 | Prescott | 294/1 R |
| 3,841,684 | 10/1974 | Fleishman | 294/1 R |
| 3,850,467 | 11/1974 | Johnson | 294/25 |

*Primary Examiner*—James B. Marbert
*Attorney, Agent, or Firm*—Ladas, Parry, Von Gehr, Goldsmith & Deschamps

[57] ABSTRACT

An apparatus for picking-up and removing objects or the like, especially animal excrements, comprising a receiver portion formed of relatively rigid material and intended to be engaged by an operator, for the reception of the object to be picked-up. A substantially sack- or bag-like sleeve is provided for such receiver portion. This bag-like sleeve, after having picked-up the object, can be forwardly turned over the receiver portion and, if desired, closed.

7 Claims, 2 Drawing Figures

APPARATUS FOR PICKING-UP AND REMOVING OBJECTS

BACKGROUND OF THE INVENTION

The present invention relates to a new and improved construction of apparatus for picking-up and removing objects, in particular although not exclusively animal excrements.

In the context of this disclosure, and while the invention has particular utility with respect to the removal of animal excrements, nonetheless it should be understood that the term "object" is used in its broader sense as referring generally to contaminants or wastes and is not simply specific to the removal of such type substances or "objects", as the disclosure will clearly suggest other possible uses of the apparatus.

It has been frequently observed that animals, especially domestic pets, typically dogs, tend to deposit their feces or excrements at locations which are particularly annoying to humans. Oftentimes, this happens especially at parking garages, areas in front of or in houses and other buildings, parks, trails, sidewalks and other paths used by pedestrians or hickers, and so forth. Up to the present the removal of such feces or excrements has been associated with considerable difficulties and, in instances where there was not available a suitable removal device, such feces removal was not possible at all.

Similar waste disposal problems can also arise in hospitals, nursing homes and the like, where oftentimes waste materials, such as for instance cotton and other contaminated objects or articles are to be removed.

SUMMARY OF THE INVENTION

Hence, with the foregoing in mind it is a primary object of the present invention to provide a new and improved construction of apparatus for picking-up and removing various types of articles or the like, especially with the view of solving the aforementioned waste removal problems.

Another and more specific object of the present invention aims at the provision at a new and improved construction of apparatus for picking-up and removing various types of objects or substances, typically, but not exclusively for instance, animal excrements, contaminated products, especially for hygienic purposes, such as items contaminated in hospitals or the like, such as cotton, throwaway instruments, dispensers, and so forth, which apparatus is relatively simple in construction and design, economical to manufacture, and easy to use.

Still a further significant object of this invention aims at the provision of apparatus for seizing and removing articles in a simple manner for the purpose of disposing of the same in a hygienic and safe way.

Yet another object of this invention aims at providing an apparatus or device of the character described which eliminates the existing difficulties and is extremely simple to use.

Now in order to implement these and still further objects of the invention, which will become more readily apparent as the description proceeds, the apparatus of the present invention is manifested by the features that there is provided a receiver portion or unit formed of relatively rigid material for picking-up the object and intended to be engaged by an operator. There is also provided a substantially bag- or sack-like sleeve for such receiver portion, which sleeve, after picking-up the object, can be folded or forwardly turned over the receiver portion and, if desired, closed.

A particularly advantageous constructional manifestation of the inventive apparatus is characterized by a substantially sack- or pocket-shaped container having opening means, and the edges of which are reinforced. This sack-shaped container means or receptacle forms the receiver portion or unit. There is also provided a sack- or bag-like sleeve which is arranged at the outside of the first-mentioned container means or receptacle and extends rearwardly from the opening or opening means thereof. This sack-like sleeve is equipped with an opening at its rear end through which there can be introduced the hand or arm of the operator, and following picking-up of the object such sack-like sleeve can be folded-over forwardly and closed in such position.

An especially preferred embodiment of the invention contemplates arranging along the edges of the opening of the container means forwardly protruding gripper elements formed of relatively stiff material. These gripper elements can be inwardly folded towards one another to provide a closable-type arrangement of gripper elements which are then forwardly folded or bent when they impact against a support surface or the like.

The gripper elements preferably consist of plastic strips or equivalent structure fixed to the inner wall of the container means or receptacle in any convenient fashion, for instance by welding. Such container or container means and the sleeve are advantageously formed of plastic, for instance of a polyethylene-foil material.

A further, particular advantageous constructional embodiment of the invention is manifested by the features of a scoop- or shovel-like receiving surface for the object to be raised and forming the receiver portion or part. This scoop-like receiving or receiver surface is formed of relatively rigid material. At the rear end of the receiving surface there is attached a sack-like sleeve intended to be folded forwardly, following picking-up of the object, over the receiver surface and, if desired, can be closed.

The receiver or receiving surface extends with its rear end advantageously into the base or floor portion of the sleeve or sleeve member, in order to be seized from within such sleeve. The aforementioned receiver surface also advantageously possesses two lateral guide surfaces which, for instance, can be upwardly flexed or folded out of the plane of the receiver surface along fold lines, and specifically, from a location within the sleeve.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
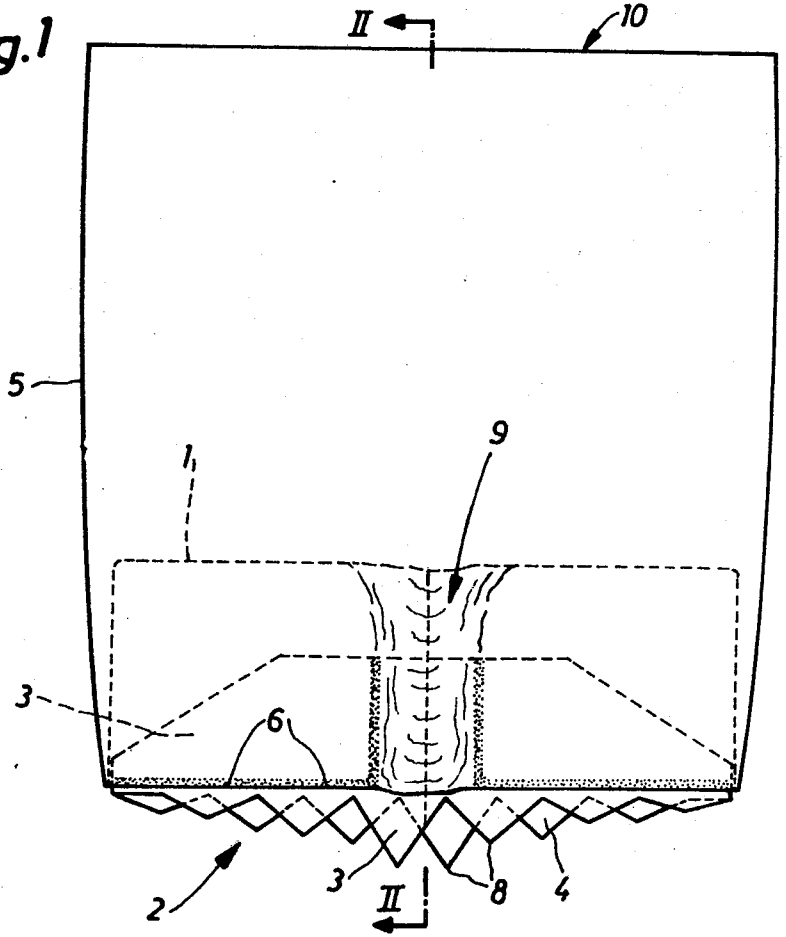
FIG. 1 is a schematic view of a waste disposal apparatus constructed according to the present invention.
Figure 2:
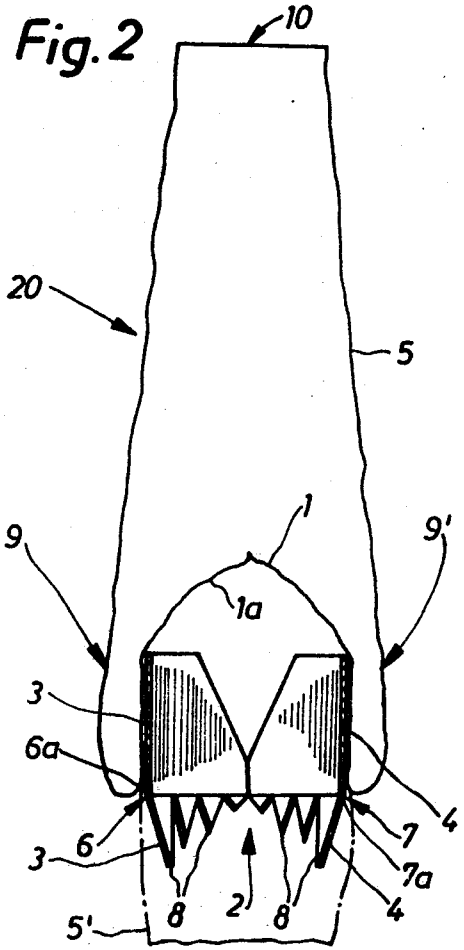
FIG. 2 is a cross-sectional view of the apparatus shown in FIG. 1, taken substantially along the lines II—II thereof.

Describing now the drawings, and as disclosed specifically in FIGS. 1 and 2, the exemplary embodiment of waste disposal apparatus depicted therein, is especially suitable for instance for the hygienic removal and packaging of relatively solid animal excrements, such as for instance the feces of dogs. Prior to use such apparatus will be seen to comprise a substantially sack- or pocket-like inner container or receptacle 1 having an opening 2 along which there is arranged forwardly protruding gripper elements or members 3 and 4. There is also provided an external sleeve or sleeve member 5.

In the embodiment under discussion the container 1 and the sleeve 5 are fabricated of the same piece i.e. manufactured of one-piece, and are formed by inwardly folding- or turning-over the floor or bottom of a sack 20 formed, for instance, of plastic. Depending upon the mode of use, the plastic sack 20 may be transparent or non-transparent.

The gripper elements 3 and 4 each are formed of, for instance, a cardboard strip which is fixed to the inner wall of the container or receptacle 1, for instance by adhesively bonding the same thereto. At the locations 6 and 7 there are formed so-called bend or fold notches or lines, generally indicated by reference characters 6*a* and 7*a*. The outer edges of the gripper elements 3 and 4 are provided with gripper teeth 8 or equivalent structure, which upon closing of the bendable teeth 8 mutually engage with one another.

The outer parts of the gripper elements 3 and 4, that is to say, those portions of the gripper elements located externally of the bend notches or lines 6*a* and 7*a*, can be easily inwardly bent from their illustrated starting position, i.e. slightly initially flexed or bent towards one another, so that when the gripper teeth are pressed against a supporting surface or the like the same automatically can easily close.

By simply slightly pulling together or otherwise appropriately folding the sack walls, especially the walls ot the sack-like sleeves 5, there are formed respective arched or domed portions 9 and 9' at the intermediate region of the gripper elements 3 and 4 between the walls 1*a* of the container 1 and the sleeve 5, these domed portions 9 and 9' forming pockets into which there can be inserted the fingers of the user.

Use of the described apparatus is extremely simple: the sleeve 5 and container 1 preferably consist of a plastic material, for instance polyethylene foil, and can be wound for instance about the gripper elements 3, 4 which provide reinforcing means for the container 1 defining the waste receiver portion for the waste or otherwise. This unit, prior to use, and while assuming approximately the position shown in the drawings, is engaged from the rear, and specifically the hand or arm of the user is inserted through the rear entry-opening 10 of the sleeve 5 and the user's fingers are conveniently inserted into the domed portions or pockets 9, 9'. Now the apparatus together with the gripper elements 3, 4 can be placed over the object which is to be picked-up. By depressing the apparatus with the hand, in the direction of the surface upon which the object to be picked-up rests, the object is then picked-up and the gripper elements 3, 4 are inwardly bent at the fold lines 6*a*, 7*a* and the gripper teeth 8 engaged with one another to provide a closure to prevent unintentional dropping out of the thus engaged object. Then the bag-like sleve 5 is upset or folded-over towards the front, into the position shown in phantom lines by reference character 5', and the unit can be closed in the manner of a conventional bag. It will be appreciated that the picked-up waste is completely contained within the closed bag.

The apparatus can be used in an extremely hygienic manner. The object to be picked-up must not be touched by the user with his hands and after having used the apparatus all of the waste is hygienically sealed or packaged.

As already mentioned, the apparatus is suitable for picking-up the feces or excrements of dogs. However, it also can be used in other fields, such as for instance in hospitals, laboratories, just to mention a few possibilities.

While there is shown and described a present preferred embodiment of the invention, it is to be distinctly understood that the invention is not limited thereto, but may be otherwise variously embodied and practiced within the scope of the following claims.

Accordingly, what is claimed is:

1. An apparatus for picking-up and removing objects, such as animal excrements, comprising:

an inner container portion for receiving the object to be picked up, said container defining an opening bounded by edges thereof whereby such object can be introduced into the container;

an outer sleeve portion arranged outside the container and extending rearwardly of the container opening, the sleeve portion having a rear end provided with an opening through which the hand of the operator of the apparatus can be inserted to engage the outside of the container, the sleeve portion being foldable over the container portion following picking up of the object; and means for reinforcing the edges of the container opening, the reinforcing means including forwardly protruding gripper elements formed of relatively stiff material providing along the edges of said container opening, said gripper elements being structured such that they can be inwardly folded towards each other when said gripper elements engage a supporting surface upon which the object to be picked up is disposed.

2. The apparatus as defined in claim 1, wherein said container portion and said sleeve portion are formed of one-piece, providing a sack-like element including an inwardly folded floor which forms said container portion, said container portion having wall means at which said reinforcement means are provided at the region of the container opening.

3. The apparatus as defined in claim 1, comprises two opposed gripper elements provided along opposite edges of the container opening, the two gripper elements having interengageable teeth and being inclined towards each other, whereby pressing the apparatus towards a supporting surface upon which the object to be picked up is disposed causes said teeth to be brought together between said supporting surface and said object.

4. The apparatus as defined in claim 1, wherein:

said gripper elements are formed of strips of material and include gripper edge means equipped with teeth.

5. The apparatus as defined in claim 1, wherein:

said container portion and said sleeve are formed of one-piece.

6. The apparatus as defined in claim 1, further including:

rearwardly open pocket means defining through-passages arranged at the central region of the reinforced edges of said opening between wall means of the container portion and the sleeve portion;

said pocket means serving for the reception of fingers of the operator in order to maintain the reinforced edges of the opening in a suitable starting position.

7. The apparatus as defined in claim 6, wherein:

said pocket means are formed by substantially domed portions of said sleeve.

* * * * *